United States Patent [19]

Hirano et al.

[11] Patent Number: 4,833,058

[45] Date of Patent: May 23, 1989

[54] DEVELOPING APPARATUS

[75] Inventors: Yasuo Hirano; Kazuo Nojima; Motoi Orihara, all of Numazu, Japan

[73] Assignee: Ricoh Co., Ltd., Tokyo, Japan

[21] Appl. No.: 98,061

[22] Filed: Sep. 17, 1987

[30] Foreign Application Priority Data

Sep. 26, 1986 [JP] Japan ..... 61-227856

[51] Int. Cl.[4] ..... G03G 13/08

[52] U.S. Cl. ..... 430/120; 430/122; 428/447; 355/259

[58] Field of Search ..... 430/120, 122, 110; 428/447, 450; 355/3 DD

[56] References Cited

U.S. PATENT DOCUMENTS 4,522,907 6/1985 Mitsuhashi et al. ..... 430/120

4,702,964 10/1987 Hirano et al. ..... 430/110

*Primary Examiner*—John L. Goodrow

*Attorney, Agent, or Firm*—Flynn, Thiel, Boutell & Tanis

[57] ABSTRACT

This invention relates to a developing apparatus for one component type toner, which has a thin film-forming element applying a thin film of one component type toner on the surface of a toner holder, characterized in that said thin film-forming element is composed of a silicone rubber comprising 100 parts by weight of a siloxane polymer having a cross linking density of $4\text{–}8\times10^{-4}$ mol/cc and 30–70 parts by weight of silica.

14 Claims, 4 Drawing Sheets

DEVELOPING APPARATUS

BACKGROUND OF THE INVENTION

1. Field of the Invention

This invention relates to a developing apparatus for a one component type toner.

2. Description of the Prior Art

As one of the general methods for developing non-magnetic one component type toners, there has usually been proposed a developing method comprising the steps of laminating the toner on a toner holder (namely, a developing roller) by means of a blade-shaped or roller-shaped element, and abutting the same on a photosensitive element that has formed electrostatic latent images thereon. In this instance, the thin film-forming element has been required to have such properties as releasability to toner, abrasion resistance, chargeability to toner and the like. Therefore, a metal such as stainless steel or the like, a fluorine-containing resin, a denatured fluorine-containing resin or the like has been employed. However, the metal has been very defective in that since the metal is very inferior in the releasability to toner, the toner adheres onto the abutting surface, stripes take place on the thin toner layer, and said stripes appear on the image taking the form of white stripes. In the case of the element formed of the fluorine resin or the like, it has been defective in that said element is short-lived because it is superior in the releasability to toner but very inferior in abrasion resistance, and that since it is so strong in the minus chargeability, it is easy to positively charge the toner but is difficult to negatively charge the toner, whereby said element is difficult to use in common with both plus and minus toners. Further, even when using the denatured fluorine-contained resin, that is a copolymer with another resin represented by polyethylene or the like, as an improved fluorine-contained resin, the abrasion resistance and the chargeability to toner are somewhat improved but the releasing ability deteriorates, thereby causing the toner to adhere.

Next, it is seen from Japanese Laid-Open Patent Application No. 66442/1982 that even when using the silicone resin, denatured silicone resin and silicone oil as the friction charging element, it was inferior in the points of abrasion resistance and releasing ability to toner.

In view of the aforegoing, there has been demanded an element that is capable of simultaneously satisfying the various characteristics required for the toner thin film-forming element, particularly those such as abrasion resistance, releasing ability to toner and chargeability to toner.

SUMMARY OF THE INVENTION

The object of this invention is to provide a developing apparatus that has eliminated the defects inherent in the conventional developing apparatuses. In other words, the object of this invention is to provide a developing apparatus for a one component type toner, which has a thin film-forming element applying a thin film of a one component type toner on the surface of a toner holder (a developing roller), characterized in that said thin film-forming element is composed of a silicone rubber comprising 100 parts by weight of a siloxane polymer having a cross linking density of $4\text{–}8\times10^{-4}$ mol/cc and 30–70 parts by weight of silica.

DETAILED DESCRIPTION OF THE INVENTION

Figure 1:
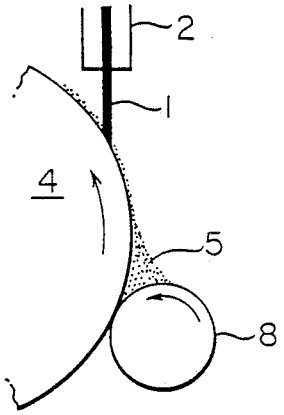
FIG. 1, FIG. 7 and FIG. 8 are each a schematic view illustrating the developing apparatus using the thin film-forming element according to this invention.

The inventors have devoted themselves to various studies for the purpose of achieving the aforesaid object to find that said object can be achieved by providing a developing apparatus for one component type toner, which has a thin film-forming element applying a thin film of one component type toner on the surface of a toner holder (a developing roller), characterized in that said thin film-forming element is composed of a silicone rubber comprising 100 parts by weight of a siloxane polymer having a cross linking density of $4\text{–}8\times10^{-4}$ mol/cc and 30–70 parts by weight of silica.

This invention is characterized by using a silicone rubber as a thin film-forming element applying a thin film of one component type toner, and is characterized in that said silicone rubber comprises 100 parts by weight of a siloxane polymer having a cross linking density of $4\times10^{-4}\text{–}8\times10^{-4}$ mol/cc and 30–70 parts by weight of silica.

The cross linking density of the siloxane polymer can be measured by the ways described in R. B. PRIME, Thermochimica Acta 26, (1978), 166–174, and "Applied Development of Silicone Rubber" Polymer Digest, 1980, 8, p59–60.

That is, a sample (5 mm×20 mm) is cut off from a rubber sheet molded so as to have a thickness of 2 mm by vulcanization, and immersed in 50 ml of toluene at room temperature. And, the weight of the toluene-containing sample is measured at suitable intervals. When the difference between two values measured at intervals of 24 hours becomes 1% or less of the weight of the sample, said weight of the sample is named W(g).

Then, said sample is air-dried, thereafter dried at 120° C. for 3 hours to remove the toluene, and measured in respect of Weight Wo(g).

Then, the same is put on a platinum boat, heated to 900° C. at a heating speed of 10° C./min or less in nitrogen atmosphere, held at 900° C. for 10 minutes, and thereafter cooled, whereby the weight of the remaining sample Wf(g) is measured.

The cross linking number No/Vo(mol/cc) contained in 1 cc of a vulcanized rubber is calculated using the above measured values according to the following formula:

$$No/Vo = \frac{-[\ln(1 - v_2) + v_2 + 0.465v_2^2]}{106.27 \times (v_2^{\frac{1}{3}} - v_2/2)}$$

wherein $$V_2 = \frac{\left(\frac{Wo - Wf}{Wo}\right)/0.98}{\left(\frac{Wo - Wf}{Wo}\right)/0.98 + \left(\frac{W - Wo}{Wo}\right)/0.867}$$

The obtained cross linking number is made a cross linking density.

In case the polymer of the silicone rubber has a cross linking density of less than $4\times10^{-4}$ mol/cc, the silicone rubber grows weak in the molecule-molecule bond, becomes easily worn away and is short-lived as the thin film-forming element. In case the polymer has a cross linking density of less than $4\times10^{-4}$ mol/cc, further, the toner becomes liable to adhere onto the thin film-forming element, and white stripes are liable to occur on the toner thin film. In case the polymer has a cross linking density of more than $8\times10^{-4}$ mol/cc, contrarily, splits and cracks are liable to occur upon processing, thereby preventing the smooth thin film formation.

The thin film-forming element composed of a silicone rubber, which is flexible as compared with the conventional rigid element, is liable to conform with developing rollers and the like and is free from unevenness on the roller abutting surface. Thus, the silicone rubber as claimed in the present invention is a suitable material as a thin film-forming element. The silicone rubber normally comprises compounding a polysiloxane selected from dimethylpolysiloxane, methylvinylpolysiloxane, methylphenylpolysiloxane, diphenylpolysiloxane, fluoropolysiloxane and the like; reinforcing agents represented by dry silica, wet silica and the like; weighing fillers represented by diatomaceous earth, quartz and the like and additives to be added according to various objects and then mingling the same. Examples of a cross-linking agent used for the cross-linking reaction of polysiloxane include 2,5-dimethyl-2,5-di(t-butylperoxy)hexane, dicumyl peroxide, benzoyl peroxide and the like.

The silicone rubber thus obtained can be roughly classified into high temperature vulcanization type (HTV), low temperature vulcanization type (LTV) and room temperature vulcanization (RTV) depending on curing temperatures.

Mechanical characteristics, electric characteristics and the like of the silicone rubber vary widely depending on the size of the sieve structure of polysiloxane (polymer cross linking density) and the surface properties and the contents of silica used as a reinforcing agent.

The relationship between each characteristic and the silicone rubber will be concretely stated hereinafter.

(i) Releasing ability to toner, abrasion resistance test:

100 parts by weight of a silicone raw rubber having respective polymer cross linking densities (cross linking densities at the time when the polymer alone has been cured) of $1.24\times10^{-4}$, $3.62\times10^{-4}$, $5.09\times10^{-4}$, and $7.21\times10^{-4}$ mol/cc were kneaded with wet silica (D-17 manufactured by Degusa Inc.) in amounts of 30, 50 and 70 parts by weight respectively, thereby obtaining 12 kinds of silicone rubber compositions. 100 parts by weight of the silicone compositions thus obtained was kneaded with 1 part by weight of a vulcanizing agent, and the same was press molded into a 2 mm-thick silicone rubber sheet under the following conditions:

| | |
|---|---|
| Primary vulcanizing temperature | 170° C. |
| Primary vulcanizing time | 10 min. |
| Primary vulcanizing pressure | 130/Kg/cm$^2$ |
| Secondary vulcanizing temperature | 200° C. |
| Secondary vulcanizing time | 4 hours |

The adhesive strength of this silicone rubber sheet to toner was measured by the following way.

Measurement of adhesive strength

Said silicone rubber sheet (15 mm×2 mm) was pasted on a sheath heater, while a paper was fixed on another sheath heater. $5\times10^{-2}$g/cm$^2$ of a toner obtained by melting, kneading and grinding the following composition was placed film-wise on said paper. Then, both the surface temperature of rubber sheet and the surface temperature of toner were heated to 120° C. by means of sheath heaters respectively. Thereafter, the rubber sheet was pressed on the toner surface under a pressure of about 3 Kg/15 mm×15 mm for 2 minutes, and then the rubber sheet was separated at a speed of 40 mm/min. The largest value applied between the rubber sheet and the toner was made the adhesive strength (g/2.25 cm$^2$) to toner.

(Toner composition)

| | |
|---|---|
| Stylene-acrylate resin | 100 parts by weight |
| Nigrosine dye | 2 parts by weight |
| Carbon black | 10 parts by weight |

Figure 2:
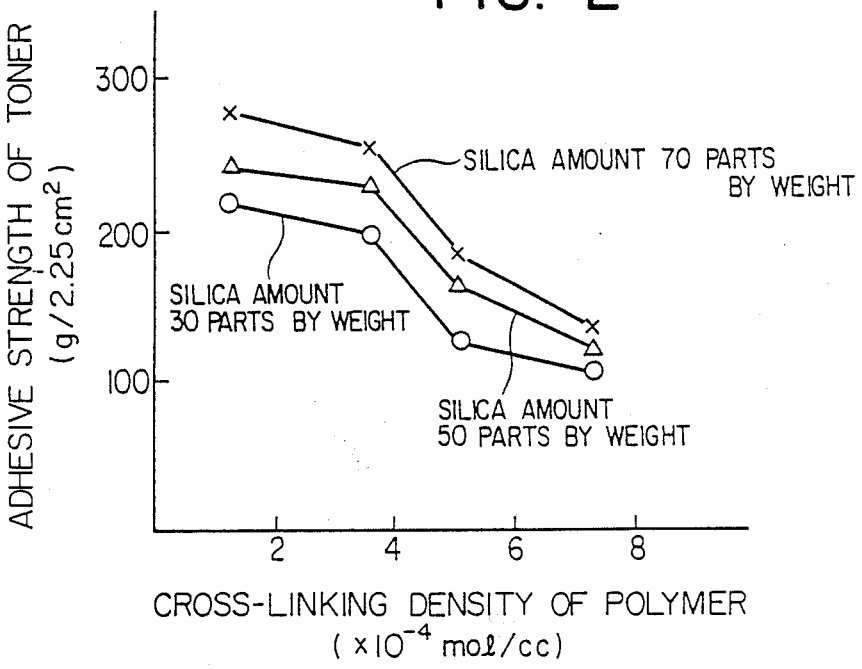
FIG. 2 is a graph illustrating the relationship between the adhesive strength of toner and the cross linking density of polymer.

The measured results are as shown in FIG. 2.

It was confirmed from FIG. 2 that the adhesive strength of silicone rubber to toner varied depending on the polymer cross linking density and the silica contents of silicone rubber, and that by increasing the polymer cross linking density and decreasing the silica contents, the adhesive strength was weakened, namely the releasing ability was improved.

Measurement of Amount of Toner Sticked to Silicone Rubber Blade

Exactly the same sample was made into a 1 mm-thick silicone rubber sheet by means of the same molding way. Thereafter, an oxime-condensation type silicone rubber adhesive (SH780 manufactured by Toray Silicone) was coated thin film-wise on one side of a 20 mm×220 mm×5 mm aluminum holder washed with toluene. The silicone rubber sheet was then press-fit on the aluminum holder so that the length thereof protruding from the front end of the holder might become 2 mm. The same was left standing for 24 hours. After the adhesive had hardened, the front end of the silicone rubber sheet was cut to make an angle of 60 degrees and made a silicone rubber blade (a toner thin film-forming element).

As seen from FIG. 1, the above prepared toner thin film-forming element 1 supported by a holder 2 was fitted on a developing apparatus, and a thin film of a toner 5 supplied by a toner supply roller 8 was formed on a toner holder (developing roller) 4. The same was subjected to 24 hours' developing operation under the following conditions. The degree of toner stuck to the toner abutting surface of the silicone rubber blade 1 was observed after developing operation.

Toner: The same as used in measuring the adhesive strength

Developing roller: Carbon containing silicone rubber (roller length 220 mm, roller diameter 20 mm, rubber film thickness 6 mm, hardness 50 degrees (JISA), electric resistance $10^9$ ohm-cm)

Blade pressing: 500 g/220 mm blade length

Developing roller linear velocity: 200 mm/sec

The degree of toner sticking was classified into the following 4 ranks:

1. . . . No sticking was observed;
2. . . . Faint sticking was occurred;
3. . . . Stuck toner amount is higher than Rank 2, but can be easily wiped off;
4. . . . Stuck toner is in a molten state, and can not be wiped off.

Figure 3:
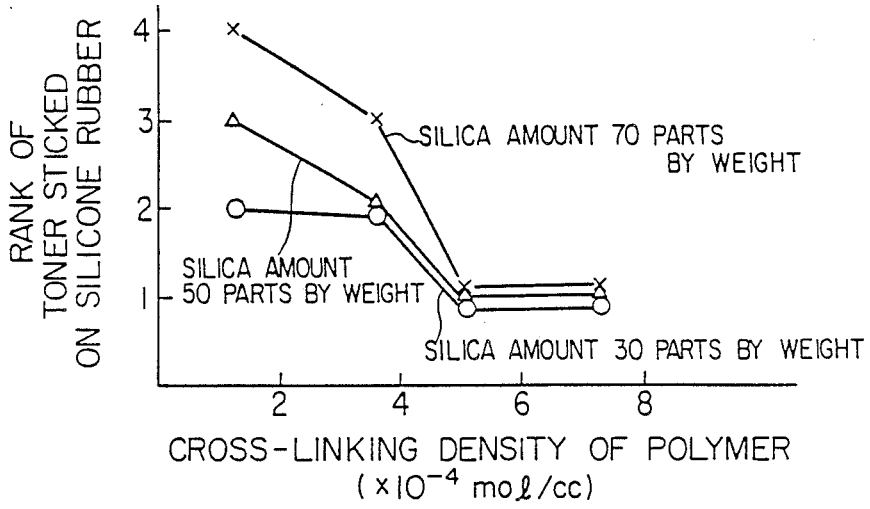
FIG. 3 is a graph illustrating the relationship between the amount of toner stuck to a silicone rubber blade and the cross linking density of polymer.

It can be seen from FIG. 3 that the sticking of toner to the silicone rubber is substantially correlevant with the adhesive strength of toner to the silicone rubber, and in case the adhesive strength is less than 200 g/2.25 $cm^2$, no sticking takes place.

Measurement of Abrasion Loss

Figure 6:
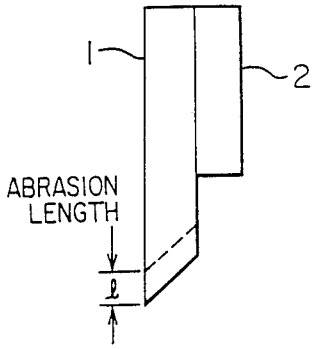
FIG. 6 is a schematic view illustrating the front end portion of the thin film-forming element.

Measurement of abrasion loss was made in the manner of measuring the lengths of the silicone rubber blade 1 supported by a holder 2 as shown in FIG. 6 before and after the abrasion test by means of a laser microgauge and making the difference between the lengths before and after the abrasion test an abrased length (l).

Figure 4:
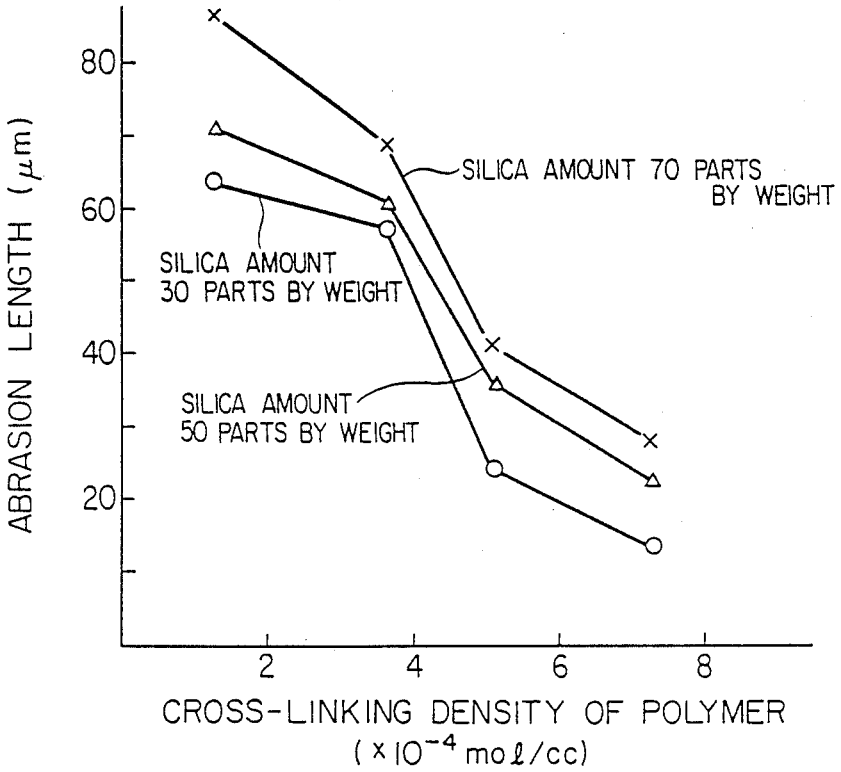
FIG. 4 is a graph illustrating the relationship between the abrasion length of silicone rubber blade and the cross linking density of polymer.

The measured results will be shown in FIG. 4.

(ii) Chargeability to toner

| | |
|---|---|
| Plus charged toner: | the same as used in above paragraph (i) |
| Minus charged toner: | |
| styrene-acrylate resin | 100 parts by weight |
| carbon | 10 parts by weight |
| chromium-containing monoazo dye (particle diameter 12 μm) | 2 parts by weight |

Figure 5:
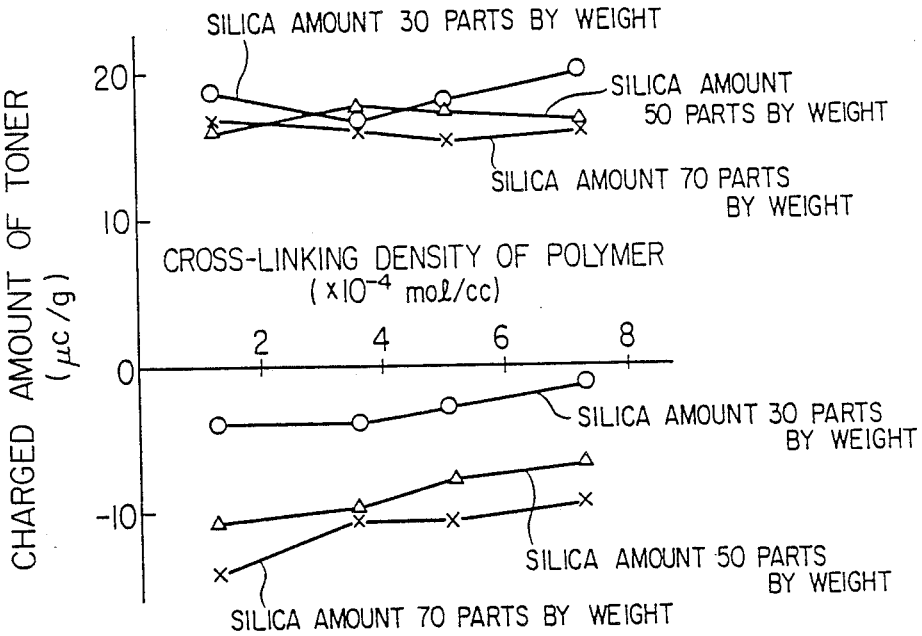
FIG. 5 is a graph illustrating the relationship between the charged amount of toner and the cross linking density of polymer.

The friction chargeability (triboelectrification) of 12 kinds of silicone rubber blades used in the above (i) to the above mentioned plus toner and minus toner was measured by blow-off method, and the measured results were shown in FIG. 5.

Reference will be made to the toner chargeability. In regard to the plus charged toner, the charged amount of toner triboelectrified by any silicone rubber is large because the silicone rubber is generally of a strong minus polarity, while in regard to the minus charged toner, the charged amount becomes smaller as the cross linking density of silicone is elevated. In this case, however, the charged amount can be increased in the manner of reducing the minus polarity of silicone rubber by the addition of a filler (silica).

When the polymer cross linking density is low, the minus chargeability of toner is elevated by the addition of silica, but when the polymer cross linking density is increased to a certain degree, the effect of the addition of silica is weakened. This is because the minus polarity of the polymer itself becomes much stronger as the polymer cross linking density is increased.

When the polymer cross linking density is within $4–8\times10^{-4}$ mole/cc, it is possible to elevate the charged amount of minus toner by the addition of 30–70 parts by weight of silica.

When more than 70 parts by weight of silica is added in this instance, a scorching phenomenon is caused, while the addition of less than 30 parts by weight of silica can not achieve the satisfactory effect of improving the chargeability.

It can be seen from the results of the abrasion test that these silicone rubbers have an abrasion loss of less than several ten microns per ten thousand copies and are so superior in abrasion resistance in comparison with the fact that the usually used fluorine resin such as tetrafluoroethylene-perfluoroalkylvinylether copolymer (which is referred to as PFA, hereinafter) or the like has an abrasion loss of several hundred microns per ten thousand copies. The life of the toner thin film-forming blade, if other characteristics are satisfied, is determined by the projecting length of the blade. By setting the projecting length to be several mm or more, there can be obtained a long-lived toner thin film-forming blade which is endurable of making more then one million copies. The silicone rubber according to this invention may further contain one of inorganic filler, crosslinking agent, thermostabilizer and processing aid other than silica in order to achieve other various objects. As the inorganic fillers, there are used powders of diatomaceous earth, quartz, iron oxide, zinc oxide, titanium oxide, calcium oxide, magnesium oxide, talc, aluminum silicate, aluminum oxide and the like; fibers of carbon black, potassium titanate, asbestos, glass, carbon and the like; and powders of Teflon, boron nitride and the like.

The toner thin film-forming element of this invention, which is superior in releasing ability and abrasion resistance, is also employable for other purposes such, for instance, as cleaning blades for photosensitive element, fixing roller, pressure roller and the like.

The toner used in the developing apparatus according to this invention is one component type toner. Typical examples of a coloring agent used herein, include carbon black, nigrosine dye, aniline blue, phthalocyanine blue, ultramarine blue, quinoline yellow, chalcooil blue and the like. Typical examples of adhesive resins include polymers and copolymers of polystyrene, chlorinated paraffin, polychlorinated paraffin, polyvinyl chloride, phenol resin, epoxy resin, polyester, polyamide, polyacrylic resin, polystyrene, polypropylene and the like.

On preparation of the toner, these colorants and adhesive resins may be used singly or in the combination of two kinds or more. These materials are added in the predetermined percentages, and are melt-kneaded in a roll mill. thereafter, they are further pulverized in a jet mill into one component type toner having a particle size of about 5–20 microns. On preparation of one component type magnetic toner, a suitable amount (10–70 wt. %) of magnetic body may be added to the above mentioned kneaded body.

In case a metal oxide, whose primary particle has an average particle diameter of 5–100 millimicrons, is mixed in the aforesaid toner, a toner fusion phenomenon may be prevented.

Examples of the metal oxides used for this purpose include silicon oxide (hydrophobic silica, hydrophilic silica), titanium oxide, aluminum oxide, cerium oxide, zirconium oxide, cobalt oxide, tin oxide, tantalum oxide and chromium oxide. These substances may be used not only singly but also in the combination of two kinds or more. This metal oxide may be used in the range of 0.01–10 wt. %, preferably 0.05–1 wt. % on the basis of the weight of the toner. The use of said metal oxide in an amount less than 0.01 wt. % does not achieve the toner fusion preventing effect, while the use of said metal oxide in an amount exceeding 10 wt. % causes ground stains, and becomes unstable to environmental variation and the like.

The metal oxide, whose particle diameter is less than 5 millimicrons, is almost ineffective in the point of abrasing, and is utterly ineffective for preventing toner fusion. On the other hand, in case the particle diameter of the metal oxide is more than 100 millimicrons, substantially the same sized cracks as toner particles are formed on a silicone rubber blade, and fine toner particles adhere thereto, thereby promoting the fusion of toner.

The abrasives other than the metal oxides such, for instance, as silicon carbide, silicon nitride, boron carbide and the like, did not exhibit any effect for preventing toner fusion. This reason has been considered that these abrasives are too strong in the abrasing effect, and substantially the same sized cracks as toner particles are formed on the blade.

Lubricants such as higher fatty acid metallic salt, polyethylene, silicone resin and the like were observed to be ineffective. This reason is considered that since the thin film forming-element is made of not metal but silicone rubber, the amount of toner fused onto the thin film forming element is too little to exhibit the lubricating effect.

The reason why the metal oxide is effective is considered that the metal oxide is polarized so as to cause a polar bond with a polar group and thus is adsorbed relatively strongly onto the silicone rubber. Said adsorbed metal oxide functions as a roller to thereby prevent the toner fusion.

This invention will be explained in more detail hereinafter with reference to the following Examples and Comparative Examples. However, it is to be understood that this invention should not be limited thereto.

The amount of each component (part) is part by weight.

EXAMPLE 1

| | |
|---|---|
| Methylvinyl polysiloxane | 100 parts by weight |
| (Polymer cross linking density | $6.8 \times 10^{-4}$ mol/cc) |
| Wet silica | 55 parts by weight |

COMPARATIVE EXAMPLE 1

| | |
|---|---|
| Methylvinyl polysiloxane | 100 parts by weight |
| (Polymer cross linking density | $6.8 \times 10^{-4}$ mol/cc) |
| Wet silica | 20 parts by weight |

COMPARATIVE EXAMPLE 2

| | |
|---|---|
| Methylvinyl polysiloxane | 100 parts by weight |
| (Polymer cross linking density | $1.5 \times 10^{-4}$ mol/cc) |
| Wet silica | 55 parts by weight |

1 part by weight of a vulcanizing agent (RC-4 manufactured by Toray Silicone) was kneaded with 100 parts by weight of each of the silicone rubber compounds obtained in Example 1, Comparative Example 1 and Comparative Example 2. Thereafter, the same was subjected to exactly the same sheet forming method and blade forming method as aforesaid, thereby preparing a silicone rubber blade having a projecting length of 5 mm.

At the same time, a PFA blade was prepared as that of Comparative Example 3, and was compared with said silicone rubber blades.

These toner thin film-forming blades were set in the developing unit shown in FIG. 1, and subjected to a continuous paper copying test (200,000 sheets) using the above mentioned plus charged toner and minus charged toner. The obtained results are shown in Table 1.

TABLE 1

| Toner | Blade characteristic | Example 1 | Comparative Example 1 | Comparative Example 2 | Comparative Example 3 (PFA blade) |
|---|---|---|---|---|---|
| ⊖ Toner | Toner charged amount (μc/g) | +15.6 | +17.5 | +13.1 | +17.1 |
| | Rank of toner sticking | 1 | 1 | 3 | 1 |
| | Blade abrasion loss (mm/200,000 sheets) | 0.72 | 0.68 | 1.22 | disqualified at 80,000 sheets |
| ⊕ Toner | Toner charged amount (μc/g) | −11.2 | −3.5 | −12.1 | +2.5 |
| | Rank of toner sticking | 1 | 2 | 3 | — |
| | Blade abrasion loss (mm/200,000) sheets | 0.75 | 0.70 | 1.15 | — |

Comparative Example 1 is superior in both the prevention of toner sticking and the abrasion resistance, but is difficult to charge the minus charging toner. Comparative Example 2 is not satisfactory in respect of the prevention of toner sticking and the abrasion resistance. In the case of the PFA of Comparative Example 3, it is of a strong minus polarity and so the minus charging toner has been positively charged, and further the plus charging toner is short of abrasion resistance. Example 1 is superior in the points of plus toner chargeability, minus toner chargeability, prevention of toner sticking and abrasion resistance. The life of blade could be surmised to be endurable of making about 1,400,000 copies judging from the abrasion loss of the blade at the time when 200,000 sheets have been fed.

EXAMPLE 2

| | |
|---|---|
| Styrene-acrylic acid copolymer | 100 parts |

-continued

| | |
|---|---|
| (Highmer SBM-700 manufactured by Sanyo Kasei K. K.) | |
| Low molecular weight polypropylene | 5 parts |
| Nigrosine type dye (Bontron N-06 manufactured by Orient Kagaku K. K.) | 2 parts |
| Carbon black (C #44 manufactured by Mitsubishi Kasei Kogyo K. K.) | 10 parts |

A mixture of the above components was heated and melted in a roll mill at 120°-130° C. for about 30 minutes, and the same was cooled to room temperature. The resultant mixture was ground to thereby obtain a toner having a particle diameter of 5-15 microns. 0.3 parts of $\alpha$-$Al_2O_3$ (average particle diameter: 20 millimicron) was added to the above mixture, and the same was fully stirred and mixed in a speed-kneader into a toner.

The silicone rubber, namely the toner thin film-forming element, was prepared as mentioned below.

| | |
|---|---|
| Methylvinyl polysiloxane (Polymer cross linking density: $5 \times 10^{-4}$ mol/cc) | 100 parts |
| Wet silica | 70 parts |
| Vulcanizing agent (Toray RC-4) | 1 part |

A mixture of the above components was kneaded in a roll mill, and the same was press-cured at 170° C. for 10 minutes under the pressure of 100 Kg/cm$^2$.

Figure 7:
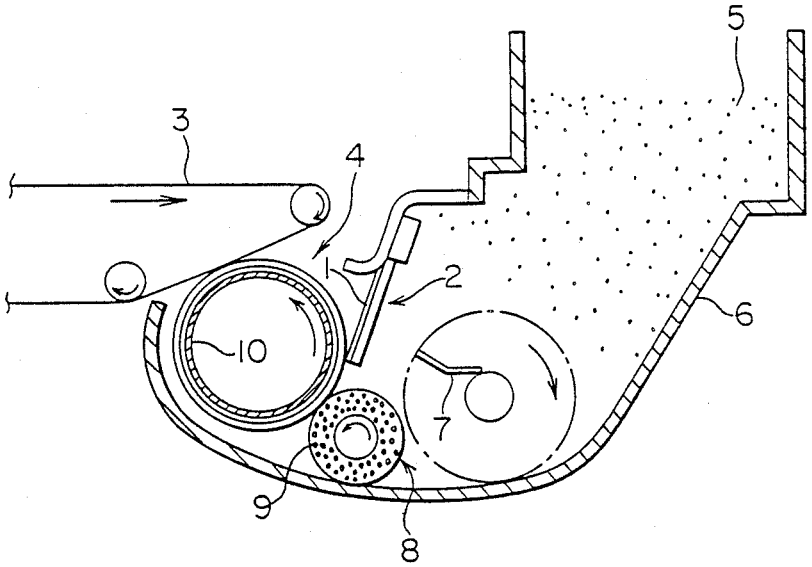

The above mentioned silicone rubber was set in the developing apparatus as shown in FIG. 7 as a toner thin film-forming element 1. A toner 5 received in a hopper 6 was supplied, with stirring by an agitator 7, onto a developing roller 4 comprising a conductive body 10 by means of a supplying roller 8 having a surface 9 made of a flexible material such as polyurethane foam or the like, and a thin film of said toner 5 was formed on said developing roller 4 by means of a toner thin film-forming element 1, thereby developing an electrostatic latent image formed on a photosensitive element 3.

In the developing operation as mentioned above, continuous copying was carried out using the aforesaid toner to thereby test the image quality and durability.

Electrostatic latent images were formed by applying 800 V minus charge to an organic photosensitive element and thereafter exposing.

The result of this test showed that the image quality was superior, and that any specific image quality difference could not be observed between the initial image and the image obtained after having continuously copied 500,000 sheets. No abnormal images having white stripes and the like could not be observed.

It was further observed that the charged amount of toner was stable, and that no fusion of toner to a toner holder and a toner film thickness-controlling element took place. Thus, a uniform toner thin film was formed on said toner holder (i.e. developing roller).

EXAMPLE 3

A toner having substantially the same sized particle diameter as that of the toner of Example 2 was prepared by using a mixture of the undermentioned components in accordance with the same procedure as in Example 2.

| | |
|---|---|
| Polyester resin | 100 parts |
| Low molecular weight polypropylene | 4 parts |
| Azo type dye | 3 parts |
| Carbon black | 7 parts |

To said toner was added 0.1 part of $\alpha$-$Al_2O_3$ (average particle diameter: 30 millimicrons) powder, and the same was mixed in a speed-kneader, thereby obtaining a toner. A silicone rubber was prepared according to the same procedure as in Example 2, except that the polymer cross linking density of the methylvinyl polysiloxane was changed into $7 \times 10^{-4}$ mol/cc.

Figure 8:
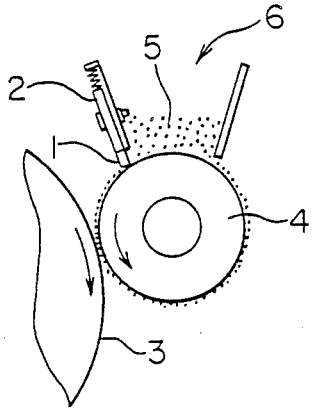

Negative-positive development was effected by using the above prepared silicone rubber and toner in the developing apparatus of FIG. 8 to thereby carry out a continuous copying test. An electrostatic latent image on a photosensitive element 3 is developed by a developing roller 4, on the surface of which a thin film of toner is formed by a silicone rubber blade 1 supported by a holder 2. Toner 5 is supplied from a hopper 6 onto the developing roller 4 in an amount controlled by the silicone rubber blade 1.

The obtained results showed that the image quality was good, and that any specific image quality difference could not be observed between the initial image and the image obtained after having continuously copied 500,000 sheets. No abnormal images having white stripes and the like could not be observed. Further, the charged amount of toner was stable, and no fusion of toner to a toner conveying element (i.e. developing roller or toner holder) and a toner film thickness-controlling element (i.e. thin film-forming element) took place, whereby a satisfactory uniform toner thin film was formed on said toner conveying element.

COMPARATIVE EXAMPLE 4

The same copying test as in Example 2 was carried out, except that the silicone rubber of Example 2 was replaced by the fluorine-contained resin. In the beginning, high quality thin films were formed, and the obtained images did not cause any troubles. After having continuously copied 30,000 sheets, however, fusion of toner to the toner thin film-forming element took place, and the image quality was deteriorated conspicuously owing to ground stains. When the continuous copying was further continued, white stripes were caused on the obtained images.

EXAMPLES 4-6

Toners were prepared respectively according to the same procedure as in Example 2, except that the kind and amount of the metal oxide in Example 2 were changed as shown in the following Table 2. Continuous copying test was carried out under the same conditions as in Example 2. The obtained results are as shown in the following Table 2.

TABLE 2

| | Metal oxide | Image Quality | Toner Fusion |
|---|---|---|---|
| Example 4 | hydrophobic silica (average diameter 16 mμ) 0.1 part | | none |
| Example 5 | hydrophilic silica (average diameter 7 mμ) | | none |

TABLE 2-continued

| | Metal oxide | Image Quality | Toner Fusion |
|---|---|---|---|
| Example 6 | 0.2 part titanium oxide (average diameter 30 mμ) 0.2 part | | none |

As stated above, according to the present invention, there can be produced a toner thin film-forming element superior in the characteristics such as abrasion resistance, toner sticking, and toner chargeability appliable commonly between plus charging and minus charging toners, by using a silicone rubber having a specific polymer cross linking density and a specific silica content as a thin film-forming blade.

What we claim is:

1. A developing apparatus for developing a latent image with a one component-type toner, comprising a movable toner holder for receiving on its surface a thin film of said toner, and a stationary, doctor blade having an edge located in close proximity to said toner holder for controlling the thickness of the film of toner on said surface, said doctor blade consisting of silicone rubber composed of (1) 100 parts by weight of a siloxane polymer having a cross-linking density of from 4 to $8\times10^{-4}$ mol/cc, and (2) from 30 to 70 parts by weight of silica.

2. The developing apparatus of claim 1, wherein said siloxane polymer comprises methyl vinyl polysiloxane as the main component.

3. A method for developing electrostatic latent images with one component type toner using the developing apparatus as claimed in claim 1.

4. The developing apparatus of claim 1, wherein said silicone rubber further contains at least one of inorganic filler, crosslinking agent, thermostabilizer and processing aid.

5. The developing apparatus of claim 4, wherein said inorganic filler is at least one selected from the group consisting of diatomaceous earth, quartz powder, iron oxide, zinc oxide, titanium oxide, calcium oxide, magnesium oxide, talc, aluminum silicate, aluminum oxide, carbon black, potassium titanate, asbestos, glass, carbon fiber, polytetrafluoroethylene and boron nitride.

6. The method of claim 3, wherein said toner contains 0.01–10 % by weight of metallic oxide having an average particle size of 5–100 mμ.

7. The method of claim 6, wherein said metallic oxide is at least one selected from the group consisting of hydrophobic silica, hydrophilic silica, titanium oxide, aluminum oxide, cerium oxide, zirconium oxide, cobalt oxide, tin oxide, tantalum oxide and chromium oxide.

8. The developing apparatus of claim 2, wherein said silicone rubber further contains at least one of inorganic filler, crosslinking agent, thermostabilizer and processing aid.

9. A method for developing electrostatic latent images with one component type toner using the developing apparatus as claimed in claim 2.

10. A method for developing electrostatic latent images with one component type toner using the developing apparatus as claimed in claim 4.

11. A method for developing electrostatic latent images with one component type toner using the developing apparatus as claimed in claim 8.

12. A method for developing electrostatic latent images with one component type toner using the developing apparatus as claimed in claim 5.

13. A developing apparatus as claimed in claim 1 in which said movable toner holder is a rotatable developing roller.

14. A developing apparatus as claimed in claim 1 in which said doctor blade is flexible and planar.

* * * * *